US008269689B2

(12) United States Patent
Lin et al.

(10) Patent No.: US 8,269,689 B2
(45) Date of Patent: Sep. 18, 2012

(54) ANTENNA DEVICE

(75) Inventors: Ching-Chi Lin, Taipei (TW); Kai Shih, Taipei (TW); Yu-Yuan Wu, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 365 days.

(21) Appl. No.: 12/783,569

(22) Filed: May 20, 2010

(65) Prior Publication Data

US 2011/0285600 A1 Nov. 24, 2011

(51) Int. Cl.
*H01Q 1/48* (2006.01)

(52) U.S. Cl. ..... 343/848; 343/700 MS

(58) Field of Classification Search ..... 343/700 MS, 343/702, 846, 848
See application file for complete search history.

(56) References Cited

U.S. PATENT DOCUMENTS 6,753,817 B2 * 6/2004 Aikawa et al. ..... 343/700 MS
2010/0013730 A1 * 1/2010 Azhari ..... 343/848
2011/0285601 A1 * 11/2011 Shih et al. ..... 343/848

* cited by examiner

*Primary Examiner* — Tan Ho
(74) *Attorney, Agent, or Firm* — Lin & Associates IP, Inc.

(57) ABSTRACT

An antenna device includes an insulating substrate, a ground plane, a radiating element, a horizontal polarized portion and a vertical polarized portion. The insulating substrate has a first surface and a second surface opposite to the first surface, one end of the first surface defines a first isolating area and a second isolating area, one end of the second surface adjacent to the first and second isolating areas defines an insulating area, a horizontal feed circuit and a vertical feed circuit are disposed at the insulating area. The ground plane includes a first ground plane and a second ground plane. The radiating element is positioned opposite to and spaced from the first ground plane. The horizontal and vertical polarized portions are positioned on the radiating element and corresponding to the first and second isolating areas respectively so as to couple with the horizontal and vertical feed circuits, respectively.

7 Claims, 3 Drawing Sheets

ANTENNA DEVICE

BACKGROUND OF THE INVENTION

1. Field of the Invention

The present invention generally relates to an antenna device, and more particularly to a dual-polarized antenna device.

2. The Related Art

Currently, game machines and other consumer electronic products are more and more miniaturized and multi-functionalized. So, an antenna device used to receive and transmit electromagnetic signals need be developed towards miniaturization and high reliability. Conventionally, the antenna device includes a feed portion, a radiating element and an insulating substrate. The feed portion and the radiating element are connected directly to make the electromagnetic signals feed to the radiating element. However, the above-mentioned antenna device works at a simple communication.

SUMMARY OF THE INVENTION

An object of the present invention is to provide an antenna device. The antenna device includes an insulating substrate, a ground plane, a radiating element, a horizontal polarized portion and a vertical polarized portion. The insulating substrate has a first surface and a second surface opposite to the first surface. One end of the first surface defines a first isolating area and a second isolating area spaced from each other. One end of the second surface adjacent to the first isolating area and the second isolating area defines an insulating area. A horizontal feed circuit and a vertical feed circuit are disposed at the insulating area and spaced from each other corresponding to the first isolating area and the second isolating area respectively. The ground plane includes a first ground plane which is covered on the first surface of the insulating substrate with the first and second isolating areas exposed outside, and a second ground plane which is covered on the second surface of the insulating substrate with the insulating area exposed outside and is further electrically connected with the first ground plane. The radiating element is positioned opposite to and spaced from the first ground plane by means of the support of a plurality of mounting pillars which are inserted in the insulating substrate and projected beyond the first ground plane. The horizontal polarized portion and the vertical polarized portion are positioned on positions of the radiating element corresponding to the first and second isolating areas respectively and spaced from each other so as to couple with the horizontal feed circuit and the vertical feed circuit, respectively.

As described above, the horizontal feed circuit and the vertical feed circuit can respectively couple with the horizontal polarized portion and the vertical polarized portion so that can make the antenna device work under a duplex communication. Furthermore, an amount of solder is dropped into the apertures to electrically connect the first and second ground planes so as to achieve the horizontal electrical length of less than a quarter horizontal wavelength of the antenna device at 2.4 GHz frequency band and the vertical electrical length of less than a quarter vertical wavelength of the antenna device at 2.4 GHz frequency band, so that can further miniaturize the antenna device.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
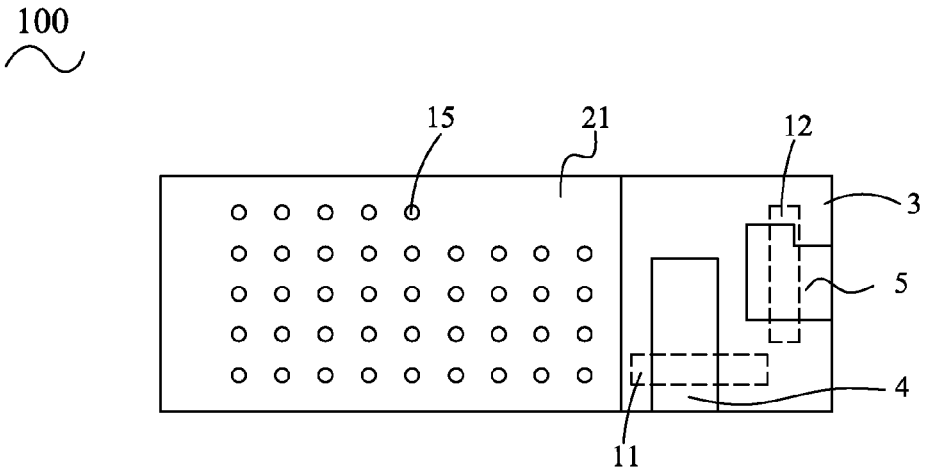
FIG. 1 is a vertical view of an antenna device in accordance with the present invention.
Figure 3:
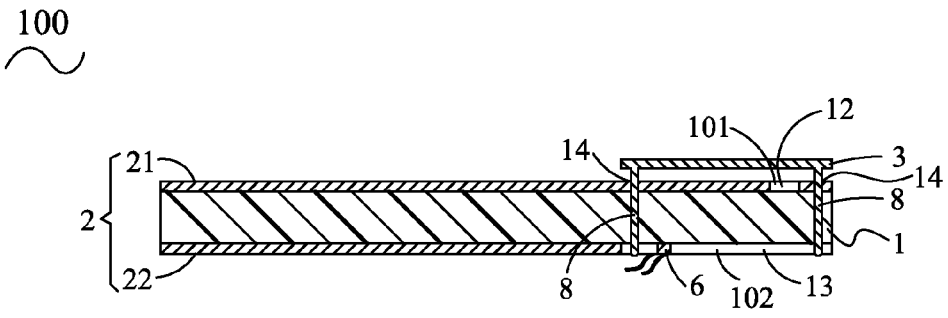
FIG. 3 is a lateral cross-sectional view of the antenna device of FIG. 1.

With reference to FIG. 1 and FIG. 3, an antenna device 100 in accordance with the present invention is shown. The antenna device 100 includes an insulating substrate 1, a ground plane 2, a radiating element 3, a horizontal polarized portion 4, a vertical polarized portion 5 and a plurality of mounting pillars 8.

Figure 2:
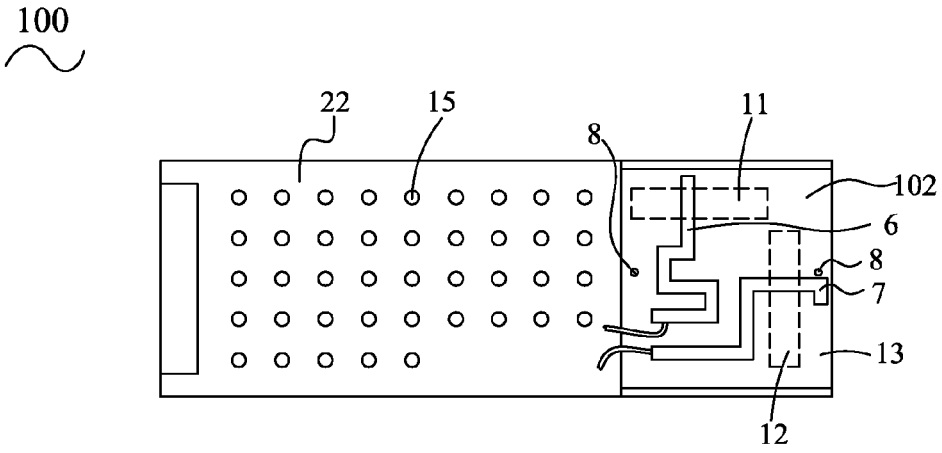
FIG. 2 is an upward view of the antenna device of FIG. 1.

Referring to FIG. 1, FIG. 2 and FIG. 3, the insulating substrate 1 is of a rectangular board configuration and has a first surface 101 and a second surface 102 opposite to the first surface 101. One end of the first surface 101 of the insulating substrate 1 defines a rectangular first isolating area 11 and a rectangular second isolating area 12 spaced from each other. One end of the second surface 102 of the insulating substrate 1 adjacent to the first isolating area 11 and the second isolating area 12 defines a square insulating area 13, and further is provided with a horizontal feed circuit 6 and a vertical feed circuit 7 which are located at the insulating area 13 and spaced from each other corresponding to the first and second isolating areas 11, 12 respectively. The first surface 101 and the second surface 102 of the insulating substrate 1 are respectively covered by a layer of metal to form a first ground plane 21 with the first isolating area 11 and the second isolating area 12 being exposed outside, and a second ground plane 22 with the insulating area 13 being exposed outside. The ground plane 2 includes the first ground plane 21 and the second ground plane 22. The antenna device 100 defines two holes 14 spaced from each other and further penetrating through the insulating area 13 and the first ground plane 21. The antenna device 100 further defines a plurality of apertures 15 penetrating through the insulating substrate 1 and the ground plane 2 at one end thereof away from the radiating element 3. An amount of solder is dropped into the apertures 15 to electrically connect the first ground plane 21 with the second ground plane 22 so as to decrease capacitance effect of the antenna device 100, and achieve a horizontal electrical length of less than a quarter horizontal wavelength of the antenna device 100 at 2.4 GHz frequency band and a vertical electrical length of less than a quarter vertical wavelength of the antenna device 100 at 2.4 GHz frequency band. So it can make the resonance impedance of the antenna device 100 achieve a best matching effect. In this invention, the insulating substrate 1 is made of a compound of epoxy resin with filler and glass fiber, the ground plane 2 is made of brass.

Referring to FIG. 1 and FIG. 3 again, the mounting pillars 8 are respectively inserted in the holes 14 and project beyond the first ground plane 21. The radiating element 3 is of square board shape and made of insulating materials. The radiating element 3 is propped by the mounting pillars 8 to face to and spaced from the first ground plane 21. The horizontal polarized portion 4 and the vertical polarized portion 5 are disposed positions of an outer surface of the radiating element 3 corresponding to the first isolating area 11 and the second isolating area 12, respectively. The horizontal polarized portion 4 is of rectangular board shape, and the vertical polarized portion 5 is of L-shaped board configuration. The horizontal polarized portion 4 and the vertical polarized portion 5 are made of brass.

In this invention, the antenna device 100 can work with an about 2.4 GHz frequency. The horizontal feed circuit 6 and the vertical feed circuit 7 respectively make a coupling with the horizontal polarized portion 4 and the vertical polarized portion 5. So a horizontal polarized electromagnetic wave and a vertical polarized electromagnetic wave can be stirred to make the horizontal and vertical polarized portions 4, 5 of the antenna device 100 work under a duplex mode. Wherein the first isolating area 11 is perpendicular to the horizontal feed circuit 6 and the horizontal polarized portion 4, and the second isolating area 12 is perpendicular to the vertical feed circuit 7 and the vertical polarized portion 5.

Figure 4:
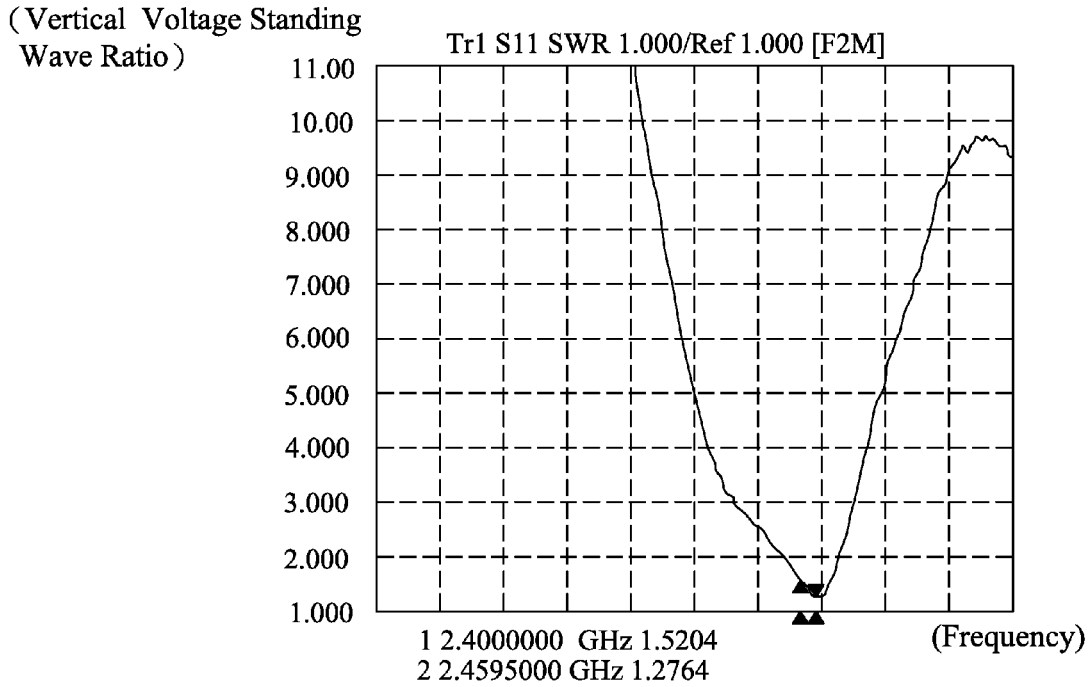
FIG. 4 is a test chart of vertical voltage standing wave ratio of the antenna device of FIG. 1.

Referring to FIG. 4, it shows a test chart of vertical voltage standing wave ratio of the antenna device 100 at wireless communication. When the antenna device 100 works at the band of 2.4 GHz, the voltage standing wave ratio is 1.704. When the antenna device 100 works at a band of 2.4595 GHz, the voltage standing wave ratio is 1.2764. Consequently, the vertical voltage standing wave ratios of the antenna device 100 are all close to 1.5. It means that the antenna device 100 has an excellent vertical frequency response between 2.4 GHz and 2.4595 GHz.

Figure 5:
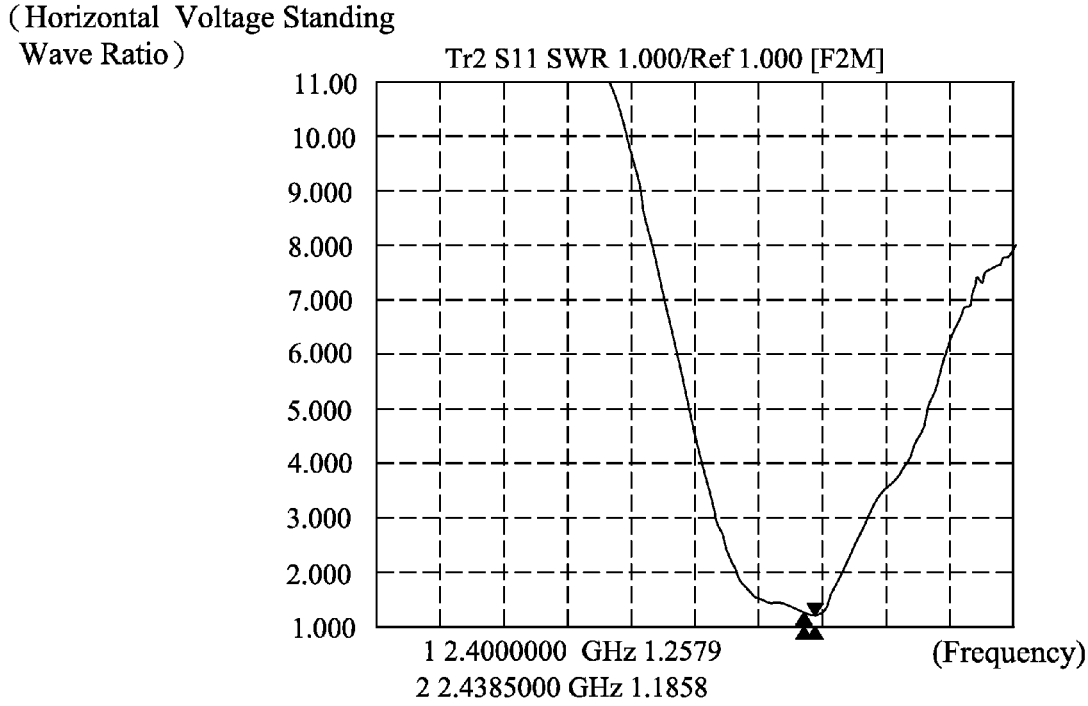
FIG. 5 is a test chart of horizontal voltage standing wave ratio of the antenna device of FIG. 1.

Referring to FIG. 5, it shows a test chart of horizontal voltage standing wave ratio of the antenna device 100 at wireless communication. When the antenna device 100 works at the band of 2.4 GHz, the voltage standing wave ratio is 1.2579. When the antenna device 100 works at a band of 2.4385 GHz, the voltage standing wave ratio is 1.1858. Consequently, the voltage standing wave ratios of the antenna device 100 are all close to 1.5. It means that the antenna device 100 has an excellent frequency response between 2.4 GHz and 2.4385 GHz.

Figure 6:
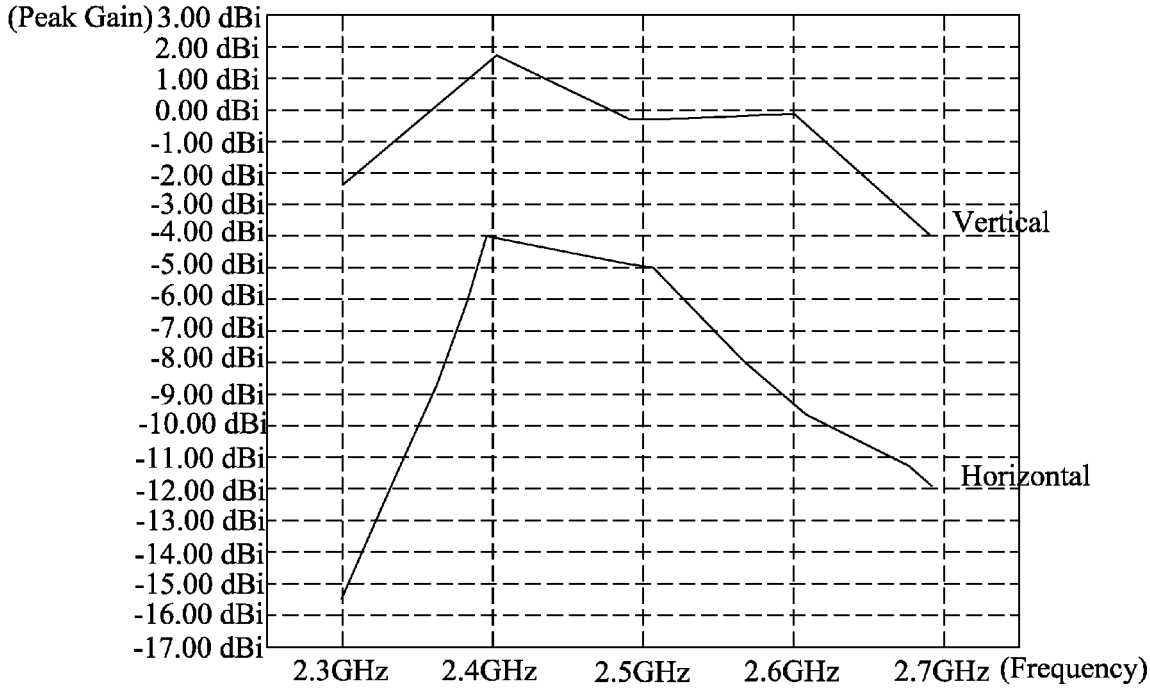
FIG. 6 is a test chart of a peak gain of a horizontal polarized portion and a vertical polarized portion of the antenna device of FIG. 1.

Referring to FIG. 6, it shows a test chart of peak gain of the horizontal polarized portion 4 and the vertical polarized portion 5 of the antenna device 100. When the antenna device 100 works at a band of 2.3 GHz, the peak gain of the horizontal polarized portion 4 is −15.37 and that of the vertical polarized portion 5 gets up to −2.4. When the antenna device 100 works at the band of 2.4 GHz, the peak gain of the horizontal polarized portion 4 gets up to 4 and that of the vertical polarized portion 5 gets up to 1.76. When the antenna device 100 works at a band of 2.5 GHz, the peak gain of the horizontal polarized portion 4 gets up to −4.94 and that of the vertical polarized portion 5 gets up to −0.57. When the antenna device 100 works at a band of 2.6 GHz, the peak gain of the horizontal polarized portion 4 gets up to −9.10 and that of the vertical polarized portion 5 gets up to −0.23. When the antenna device 100 works at a band of 2.7 GHz, the peak gain of the horizontal polarized portion 4 gets up to −12.07 and that of the vertical polarized portion 5 gets up to −3.98. It means that the antenna device 100 has an excellent receiving and transmitting performance at the band of 2.4 GHz.

As described above, the horizontal feed circuit 6 and the vertical feed circuit 7 can respectively couple with the horizontal polarized portion 4 and the vertical polarized portion 5 so that can make the antenna device 100 work under the duplex communication. Furthermore, an amount of solder is dropped into the apertures 15 to electrically connect the first and second ground planes 21, 22 so as to achieve the horizontal electrical length of less than a quarter horizontal wavelength of the antenna device 100 at 2.4 GHz frequency band and the vertical electrical length of less than a quarter vertical wavelength of the antenna device 100 at 2.4 GHz frequency band, so that can further miniaturize the antenna device 100.

What is claimed is:

1. An antenna device, comprising:

an insulating substrate having a first surface and a second surface opposite to the first surface, one end of the first surface defining a first isolating area and a second isolating area spaced from each other, one end of the second surface adjacent to the first isolating area and the second isolating area defining an insulating area, a horizontal feed circuit and a vertical feed circuit being disposed at the insulating area and spaced from each other corresponding to the first isolating area and the second isolating area respectively;

a ground plane including a first ground plane which is covered on the first surface of the insulating substrate with the first and second isolating areas exposed outside, and a second ground plane which is covered on the second surface of the insulating substrate with the insulating area exposed outside and is further electrically connected with the first ground plane;

a radiating element positioned opposite to and spaced from the first ground plane by means of the support of a plurality of mounting pillars which are inserted in the insulating substrate and projected beyond the first ground plane; and a horizontal polarized portion and a vertical polarized portion positioned on positions of the radiating element corresponding to the first and second isolating areas respectively and spaced from each other, so as to couple with the horizontal feed circuit and the vertical feed circuit, respectively.

2. The antenna device as claimed in claim 1, wherein the first isolating area is perpendicular to the horizontal feed circuit and the horizontal polarized portion, and the second isolating area is perpendicular to the vertical feed circuit and the vertical polarized portion.

3. The antenna device as claimed in claim 1, wherein the first ground plane and the second ground plane are electrically connected with each other to achieve a horizontal electrical length of less than a quarter horizontal wavelength of the antenna device at 2.4 GHz frequency band, and a vertical electrical length of less than a quarter vertical wavelength of the antenna device at 2.4 GHz frequency band.

4. The antenna device as claimed in claim 1, wherein a plurality of apertures are defined to penetrate through the insulating substrate and the ground plane for receiving solder therein so as to electrically connect the first ground plane and the second ground plane.

5. The antenna device as claimed in claim 1, wherein the first and second ground planes are formed by covering a layer of brass on the insulating substrate, respectively.

6. The antenna device as claimed in claim 1, wherein the horizontal polarized portion and the vertical polarized portion are made of brass.

7. The antenna device as claimed in claim 1, wherein the radiating element is made of insulating materials.

* * * * *